US005256837A

United States Patent [19]

Pak

[11] Patent Number: 5,256,837

[45] Date of Patent: Oct. 26, 1993

[54] PAPER CONE FOR CONE TYPE SPEAKER

[76] Inventor: Il Y. Pak, 15743 E. Valley Blvd., City of Industry, Calif. 91744

[21] Appl. No.: 787,319

[22] Filed: Oct. 30, 1991

[51] Int. Cl.[5] ..... G10K 13/00

[52] U.S. Cl. ..... 181/164; 181/166; 181/169

[58] Field of Search ..... 181/164, 166, 169, 173

[56] References Cited

U.S. PATENT DOCUMENTS

| | | | |
|---|---|---|---|
| 1,748,990 | 3/1930 | Nilson | 181/164 |
| 1,798,688 | 3/1931 | La Rue | 181/164 |
| 1,917,013 | 7/1933 | Bostwick | 181/164 |
| 4,020,299 | 4/1977 | Garner et al. | 181/166 |
| 4,100,992 | 7/1978 | Rehde et al. | 181/166 |

FOREIGN PATENT DOCUMENTS

| | | | |
|---|---|---|---|
| 1092061 | 11/1960 | Fed. Rep. of Germany | 181/166 |

*Primary Examiner*—Michael L. Gellner

*Assistant Examiner*—Eddie C. Lee

[57] ABSTRACT

A cone formed from paper such as used in speaker as a diaphragm, wherein the wing portions, which may function to reinforce the cone, are selectively arranged and extending from any point in the periphery of the larger diameter circle to any point in the smaller diameter circle of the cone which has a frusto-conical shape and a coating layer is applied to the entire surface of the cone, and a method for making a cone using a sheet of paper, wherein the method comprises steps of cutting a sheet of paper into a desired pattern simultaneously with seaming at least a pair of folding portions composed of a centeral folding line and two lateral folding lines equi-angularly and symmetricaly displaced to each side of the center line, forming wing portions by folding said lines, honding the facing surfaces of the folded portions and, coating the entire surface of the entire surface of the cone with moisture-proof material.

4 Claims, 2 Drawing Sheets

PAPER CONE FOR CONE TYPE SPEAKER

The invention relates to a cone of speaker for use as a diaphragm, more particularly a paper cone formed from a sheet of thin paper to have reinforced portions which are formed as one body with the cone.

BACKGROUND AND PRIOR ART

Many types of speaker diaphragms are well-known in the prior art and are used to transduce electric vibration into mechanical vibration. A cone type diaphragm directs acoustic sounds toward fixed orientations like a horn while the cone itself vibrates depending on the sounds.

A cone is an essential and principal element in a speaker and has to have low frequency response characteristics and high flexusal wave propagation velocity.

Such a cone should also have high stiffness and light weight and should resist heat and humidity.

In the prior art, paper is commonly used as a speaker diaphragm material by forming the cellulose fibers of paper to a certain configuration using a mold.

However, the process for making the cone is usually complex and expensive.

Furthermore, as the stiffness and tensile strength of the paper is not so high, the thickness of the cone should be increased in proportion to the output power level of the speaker of the audio system which uses the cone (e.g. from 3 mm to 4 mm for a power level of 400 watt.). In addition, if the thickness is increased, the flexural wave propagation velocity and frequency response characteristics of the cone are seriously impaired and thus accoustic properties (especially low frequency response) are decreased.

Another disadvantage of paper as a cone material is its sensitivity to humidity and to heat, causing cones made of such material to eventually deteriorate.

Therefore, such a cone loses its vibration characteristics.

It is also known to produce such a cone by molding plastic material such as liquid crystal polymer, epoxy and etc.

However, such material is expensive and in some cases toxic and have poorer low frequency response characteristics.

The plastic material is highly sensitive to heat and readily deformed at an temperature over room temperature, inevitable resulting in acoustic distortion.

Especially, if the speaker having such a cone is mounted into an vehicle, it should be kept in mind the fact that the temperature inside the vehicle often violently rises, for example, upto 60° C. or 70° C.

In this circumstance, thermal deformation of the speaker cone is accelerated and the cone may even be ruptured due to the fluctuation of the temperature.

It will be understood that conventional speakers could not have desirable properties such as low frequency response and high flexural wave propagation velocity because of the problems concerning the material of the cone.

SUMMARY OF THE INVENTION

It is, therefore, an object of this invention to provide an improved light weight and stiff cone and a method for making the same.

It is another object to provide an improved paper cone having a high stiffness, durability and high flexural wave propagation velocity without sacrificing radiating efficiency or power handling capability.

It is still further object of the invention to provide a light weight, stiff cone which resist heat and humidity.

The invention is characterized by the steps of cutting a sheet of paper into a required pattern simultaneously with seaming several folding lines to be formed into wing portions which may reinforce the cone, adhesive bonding the facing surfaces of the folded portions, thereby forming several wing portions and, coating the entire surface of the article with moistureproof material.

For a more complete understanding of the invention, reference is made to the accompanying drawings in which:

FIG. 1 is a perspective view of a speaker incorporating a cone of the present invention;

FIG. 2*a*, 2*b*, is a cross section of an embodiment of the present invention and a portion thereof is enlarged;

FIG. 3*a* and FIG. 3*b* illustrate a method for making a cone in accordance with this invention;

FIG. 4*a* and FIG. 4*b* are corresponding to FIG. 3*a* and FIG. 3*b* but illustrate another preferred embodiment of this invention;

FIG. 5 shows another type speaker incorporating a cone of this invention.

DESCRIPTION OF THE PREFERRED EMBODIMENT

Figure 1:
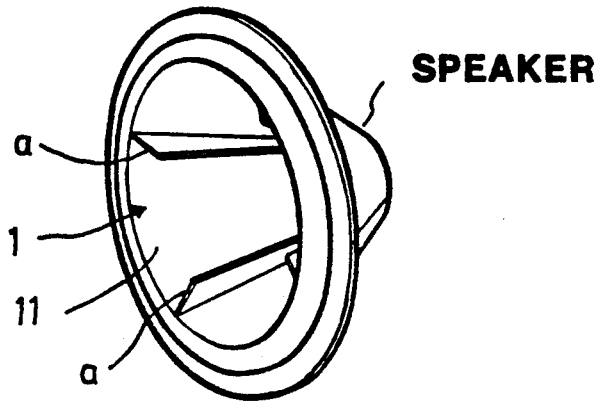
Figure 2A:
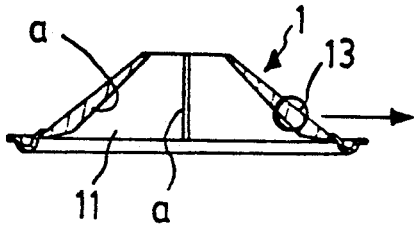
Figure 2B:
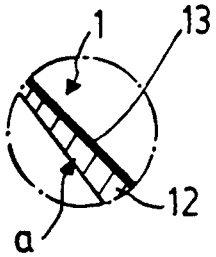

Referring to the drawings, FIG. 1 and FIG. 2*a*, 2*b*, the finished cone (1) has a frusto-conical shape.

As can be seen from the drawings, several wing portions (a), which may reinforce the cone, are provided at symmetrical positions in the cone in such a manner that each of the wing portions (a) is extended and inclined from a point in the periphery of the outer larger circle to a point in the periphery of the internal smaller circle, thereby forming tri-angular shape.

If a cone, front view of which is depicted as a circle, is required, it is preferable to form four wing portions equi-angularly spaced with each other in the circumference of the cone.

However, the invention is not limited to the number of the wing portions and may have more or less wing portions.

Figure 3A:
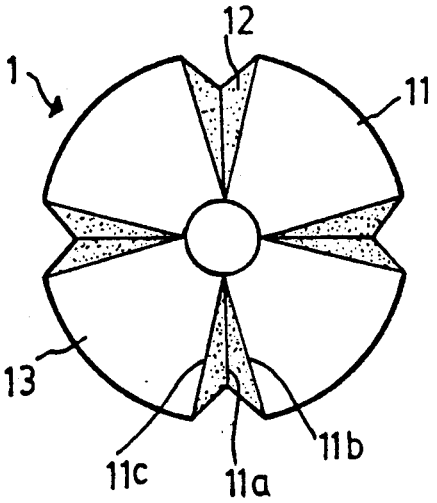
Figure 3B:
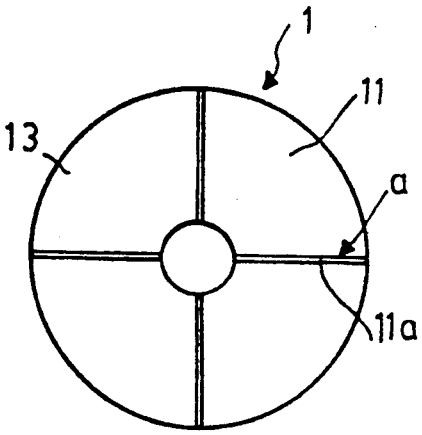

A method for making a cone using a sheet of paper is illustrated in FIG. 3. In the case of making a cone having four wing portions, a circular paper is folded at the folding lines preformed at the seaming step to form two pairs of wing portions, wing portions in each pair being opposite to each other.

At the seam step, four center folding lines, each with two lateral folding lines angularary and symmetrically displaced to its either side at a desired angle, are formed into the paper.

In other words, the folding lines may be formed as shown in FIG. 3 using any conventional press means.

Thereafter, the folding lines are folded and the folded portions are adhesive bonded by automatic bonding machine or by hand.

The cone paper is completed by coating step depositing moisture-proof material such as tar, oiled paint, enamel and etc. to the surface of the article.

The resulted wing portions(a) function as reinforcements for the cone paper.

Figure 4A:
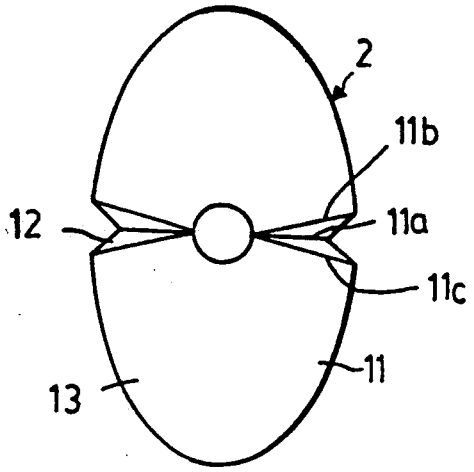
Figure 4B:
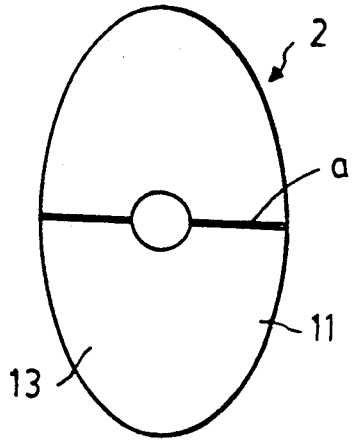
Figure 5:
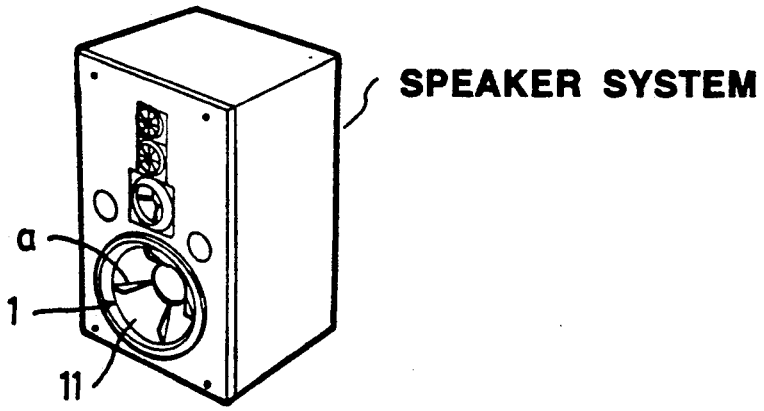

Although the aforementioned embodiment is depicted as a circular form when it is viewed from the front, alternatively the cone may be embodied as an oval shape as shown in FIG. 4.

The production method of this embodiment is basically same as that of the embodiment illustrated in FIG. 3 except that two centeral folding lines (11*a*), each of which has two lateral folding lines angularly and symmetrically displaced to its either side, are formed on the short axis of the oval dividing the cone into two upper and lower symmetrical sections.

However, the number of the wing portions is not essential and may be changed if it is preferred.

In accordance with this invention, the cone is improved in its stiffness and durability.

The cone also may be used without being affected by the output power level or acoustic pressure of a audio system which incorporates it.

This is because the cone is made from a sheet of very thin paper and several wing portions functioning as reinforcements for the cone are provided in the cone.

Furthermore, a coating layer of moisture-proof material is also applied to the entire surface of the article.

Said wing portions, moreover, function to fix numerous vibration points produced by composite vibrations of adjacent sections.

Therefore, the cone of this invention can successfully improve vibration characteristics and acoustic quality as compared to a conventional cone paper for the same output power level due to the considerably reduced thickness of the cone and above vibration fixing effect.

As the cone can be made from the steps of cutting a sheet of paper into required pattern simultaneously with seaming several folding lines to be formed into wing portions which may reinforce the cone, adhesive-bonding the facing surfaces of the folded portions, thereby forming several wing portions and, coating the entire surface of the article with moisture-proof material, the production process is very simple and easy and therefore reducing the price of finished articles.

Furthermore, as the cone is coated with moisture-proof material, the cone is insensitive to humidity and durability thereof is highly enhanced.

While a particular embodiment of the cone and a method of the invention have been shown and described, it should be understood that the invention is not limited thereto since many modifications may be made.

It is therefore contemplated to cover by the present application any and all such modifications that fall within the spirit and scope of the present invention.

What is claimed is:

1. A cone formed from paper as a diaphragm including wing portions formed of angular folds, said folds being bonded together to reinforce the cone, said wing portions selectively arranged and extending from an outer edge to the center of the cone, said cone having a frusto-conical shape and further having a coating layer applied to the entire surface of the cone.

2. The cone of claim 1, wherein said cone is circular and comprises four wing portions equi-angularly spaced and symmetrically arranged in the cone.

3. The cone of claim 1, wherein said cone is oval and comprises two wing portions symmetrically arranged on a short axis of the cone.

4. A method of making a cone using a sheet of paper comprising the steps of; cutting a sheet of paper into desired pattern simultaneously with seaming at least a pair of folding portions comprising a central folding line (11*a*) and two lateral folding lines (11*b*, 11*c*) equi-angularly and symmetrically displaced to each side of the central folding line, forming wing portions by folding at said lines (11*a*, 11*b*, 11*c*), and bonding facing surfaces of the folded portions and, coating the entire surface of the cone with moisture-proof material.

* * * * *